US009309683B1

(12) United States Patent
Huang

(10) Patent No.: US 9,309,683 B1
(45) Date of Patent: Apr. 12, 2016

(54) MOBILE TOILET WITH VENTILATION AND HEAT-DISSIPATING DEVICE

(71) Applicant: Daniel Huang, Taichung (TW)

(72) Inventor: Daniel Huang, Taichung (TW)

( * ) Notice: Subject to any disclaimer, the term of this patent is extended or adjusted under 35 U.S.C. 154(b) by 0 days.

(21) Appl. No.: 14/594,314

(22) Filed: Jan. 12, 2015

(51) Int. Cl.

| | |
|---|---|
| ***A47K 11/04*** | (2006.01) |
| ***E04H 1/12*** | (2006.01) |
| ***A47K 17/00*** | (2006.01) |
| ***A47K 11/02*** | (2006.01) |

(52) U.S. Cl.
CPC ..... *E04H 1/1216* (2013.01); *A47K 11/02* (2013.01); *A47K 17/00* (2013.01)

(58) Field of Classification Search
CPC ..... A47K 11/02
USPC ..... 4/449–486
See application file for complete search history.

(56) References Cited

U.S. PATENT DOCUMENTS

| | | | | | |
|---|---|---|---|---|---|
| 1,264,793 | A * | 4/1918 | Heniger | 4/477 |
| 1,298,658 | A * | 4/1919 | Button | 4/477 |
| 3,601,821 | A * | 8/1971 | Corsiglia | 4/300 |
| 3,629,875 | A * | 12/1971 | Dow et al. | 4/599 |
| 3,873,445 | A * | 3/1975 | Bussard | 210/149 |
| 4,744,111 | A * | 5/1988 | Tegg et al. | 4/460 |
| 4,922,557 | A * | 5/1990 | Harding et al. | 4/477 |
| 5,299,326 | A * | 4/1994 | Alexander | 4/209 R |
| 5,671,487 | A * | 9/1997 | Chen | 4/477 |
| 5,682,622 | A * | 11/1997 | Tagg | 4/449 |
| 5,683,067 | A * | 11/1997 | Slykas | 248/314 |
| 5,913,610 | A * | 6/1999 | Duck | 4/321 |
| 5,937,452 | A * | 8/1999 | Brewer | 4/460 |
| 5,974,597 | A * | 11/1999 | Conwell | 4/432 |
| 6,233,749 | B1 * | 5/2001 | Sasaki et al. | 4/213 |
| 6,393,627 | B1 * | 5/2002 | Avila | 4/449 |
| 6,402,338 | B1 * | 6/2002 | Mitzel et al. | 362/154 |
| 6,418,672 | B1 * | 7/2002 | Hampel | 52/79.1 |
| 6,427,256 | B1 * | 8/2002 | Mullett et al. | 4/476 |
| 6,507,958 | B1 * | 1/2003 | Tagg | 4/321 |
| 6,615,414 | B2 * | 9/2003 | Miller et al. | 4/321 |
| 6,622,319 | B2 * | 9/2003 | Mousseau et al. | 4/661 |
| 6,681,413 | B2 * | 1/2004 | Weiss | 4/476 |
| 6,718,565 | B1 * | 4/2004 | Cruz | 4/476 |
| 6,766,541 | B2 * | 7/2004 | Adams et al. | 4/449 |
| 7,455,582 | B2 * | 11/2008 | Barrett | 454/230 |
| 8,079,096 | B2 * | 12/2011 | Roberts | 4/476 |
| 8,091,157 | B2 * | 1/2012 | Tyler et al. | 4/477 |
| 8,499,371 | B1 * | 8/2013 | Becker | 4/476 |
| 9,074,382 | B2 * | 7/2015 | Cheng | |
| 2006/0064910 | A1 * | 3/2006 | Shankle | 40/594 |
| 2006/0260214 | A1 * | 11/2006 | Tagg | 52/79.1 |
| 2006/0277675 | A1 * | 12/2006 | Tinnell | 4/477 |
| 2007/0163036 | A1 * | 7/2007 | Holmstadt | 4/449 |
| 2009/0211002 | A1 * | 8/2009 | Norgaard | 4/111.1 |
| 2014/0143945 | A1 * | 5/2014 | Chen et al. | 4/321 |

* cited by examiner

*Primary Examiner* — Lori Baker
(74) *Attorney, Agent, or Firm* — C. G. Mersereau; Nikolai & Mersereau, P.A.

(57) ABSTRACT

A mobile toilet with a ventilation and heat-dissipating device comprises a base and a main body. The base is connected to a bottom of the main body. Ventilation openings are disposed at positions of a lower half portion of a total height of the base and the main body connected together. An exhaust port and a canopy device are disposed at predetermined positions of a top of the main body. The lower ventilation openings naturally guide air into the mobile toilet according to a chimney effect, so that hot air and stinks in the mobile toilet flow upwardly to the exhaust port, thereby heavily exhausting the hot air and the stinks and cooling the mobile toilet by a lot of natural convection. The canopy device blocks external rainwater.

6 Claims, 10 Drawing Sheets

MOBILE TOILET WITH VENTILATION AND HEAT-DISSIPATING DEVICE

BACKGROUND OF THE INVENTION (1) Field of the Invention

The invention relates to a mobile toilet with a ventilation and heat-dissipating device, and more particularly to a mobile toilet with a ventilation and heat-dissipating device, in which the chimney effect and the thermal convection principle are utilized so that the hot flow is formed in the mobile toilet, and the hot flow moves upwards. Ventilation openings are formed on the bottom of the mobile toilet to naturally guide the air into the mobile toilet, and the hot air and stinks in the mobile toilet flow upwardly to the exhaust port to heavily exhaust the hot air and stinks, to provide the heat dissipating and cooling, and to provide a lot of natural convection air in the mobile toilet, wherein the canopy device blocks the external rainwater.

(2) Description of the Prior Art

As is known in the art, when the large outdoor activity runs, there are many participating people, and mobile toilets have to be prepared to provide the requirements for many people. Therefore, the mobile toilets have become the essential provisional facilities for the large outdoor activities and play important roles. The mobile toilet is usually closed for providing the privacy and preventing the private portion from being exposed. Therefore, the stinking smell assaulting one's nostrils tends to occur, and the stinks are unbearable once the user enters the mobile toilet. In addition, most mobile toilets are made of FRP, alloy steel plates, plastic steel plates, and the heat cannot be easily dissipated when the mobile toilet is illuminated by the sun. Therefore, the temperature inside the mobile toilet is increased, and the mobile toilet is like an oven, which makes the user feel sweating in the summer.

Although the manufacturer provides the foaming material on the inner wall of the mobile toilet to provide the heat insulation to insulate the heat source, or additionally mounts a grid plate on the top of the periphery of the mobile toilet to provide the ventilation function, the stinks and hot air cannot be exhausted by way of convection. So, the exhausting and heat dissipating effects are very restricted.

Referring to FIGS. 1 to 3, a conventional mobile toilet 10 has a base 11 and a main body 12. Apparatuses, including a toilet bowl, are mounted on the base 11. The main body 12 is a rectangular box, in which a hose and water-collecting, flushing and hand-washing apparatuses can be assembled. Slots 111 for introducing air streams are formed on the base 11. The main body 12 and the base 11 are hollow and have multiple layers of walls. The air streams enter the hollow spaces 112 (FIG. 2) in the multiple layers of walls from the slots 111 of the base 11 by the natural convection of the hot air, then enter the space in the main body 12, and then the hot air and stinks are exhausted from a grid plate 121 above the main body 12. However, the air entering the hollow spaces 112 in the multiple layers of walls from the slots 111 is little, the hollow spaces 112 in the multiple layers of walls are narrow, and the entered air is little, thereby causing the poor exhausting effect of air convection.

Furthermore, as shown in FIG. 4, the manufacturer additionally mounts a ventilation apparatus 21 to the top of a mobile toilet 20 to ventilate the stinks in the mobile toilet 20 by the power of the battery or the solar energy 22. However, the battery needs to be charged in advance, the power and durability are limited, and the cost is increased. Although the solar energy 22 is the natural energy, there is no power generated in the cloudy day or rainy day.

As shown in FIG. 5, the manufacturer additionally mounts a turbo fan impeller 31 to the top of a mobile toilet 30, and the ventilation is also performed by the electric power generated by a generator. This is inconvenient.

SUMMARY OF THE INVENTION

The conventional mobile toilet is a closed toilet with the poor heat dissipating effect, or the ventilation openings are poor and cannot exhaust the hot air and stinks. So, the temperature in the mobile toilet is increased, and the user cannot bear the stinks and the high temperature.

The invention provides a mobile toilet with a ventilation and heat-dissipating device. The mobile toilet comprises a base and a main body. The base is connected to a bottom of the main body. Ventilation openings are disposed at positions of a lower half portion of a total height of the base and the main body connected together. An exhaust port and a canopy device are disposed at predetermined positions of a top of the main body. The lower ventilation openings naturally guide air into the mobile toilet according to a chimney effect, so that the hot air and stinks in the mobile toilet flow upwardly to the exhaust port, thereby heavily exhausting the hot air and the stinks and cooling the mobile toilet by a lot of natural convection. The canopy device blocks external rainwater.

A main object of the mobile toilet with the ventilation and heat-dissipating device according to the invention is to utilize the chimney effect and the thermal convection principle, so that the hot flow is formed in the mobile toilet and moves upwards. Ventilation openings are formed on the bottom of the mobile toilet to naturally guide the air into the mobile toilet, so that the hot air and stinks in the mobile toilet flow upwardly to the exhaust ports to heavily exhaust the hot air and stinks, to provide the heat dissipating and cooling in the mobile toilet, and to provide a lot of natural convection air. In addition, the canopy device blocks the external rainwater.

Another object of the mobile toilet with the ventilation and heat-dissipating device according to the invention is to provide an inverse-U shaped roof, so that the hot air and stinks in the mobile toilet flow upwardly to the exhaust port. Then, the hot air and stinks are heavily exhausted from a secondary exhaust port and a vent in the S-shaped path. The roof of the canopy device blocks the external rainwater, so that the rainwater flows out of the scupper.

Still another object of the mobile toilet with the ventilation and heat-dissipating device according to the invention is to provide an arced roof, so that the hot air and stinks in the mobile toilet flow upwardly to the exhaust port. Then, the hot air and stinks are heavily exhausted from a secondary exhaust port and a vent in the S-shaped path. The roof of the canopy device blocks the external rainwater, so that the rainwater flows out of the scupper.

Regarding yet still another object of the mobile toilet with the ventilation and heat-dissipating device according to the invention, a window on a side surface of the main body is an exhaust port, a top shutter and an oblique plate are disposed outside the exhaust port. The chimney effect and the thermal convection principle are utilized so that the hot flow is formed in the main body, and the hot flow moves upwards so that the lower ventilation openings guide the air into the mobile toilet, and the hot air and stinks in the mobile toilet flow upwardly to the exhaust port (window). Then, the hot air and stinks are heavily exhausted from the secondary exhaust port to provide the cooling and a lot of natural convection in the mobile toilet. The top shutter of the canopy device blocks the external rainwater, so that the rainwater flows out of the scupper to prevent the rainwater from entering the toilet.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
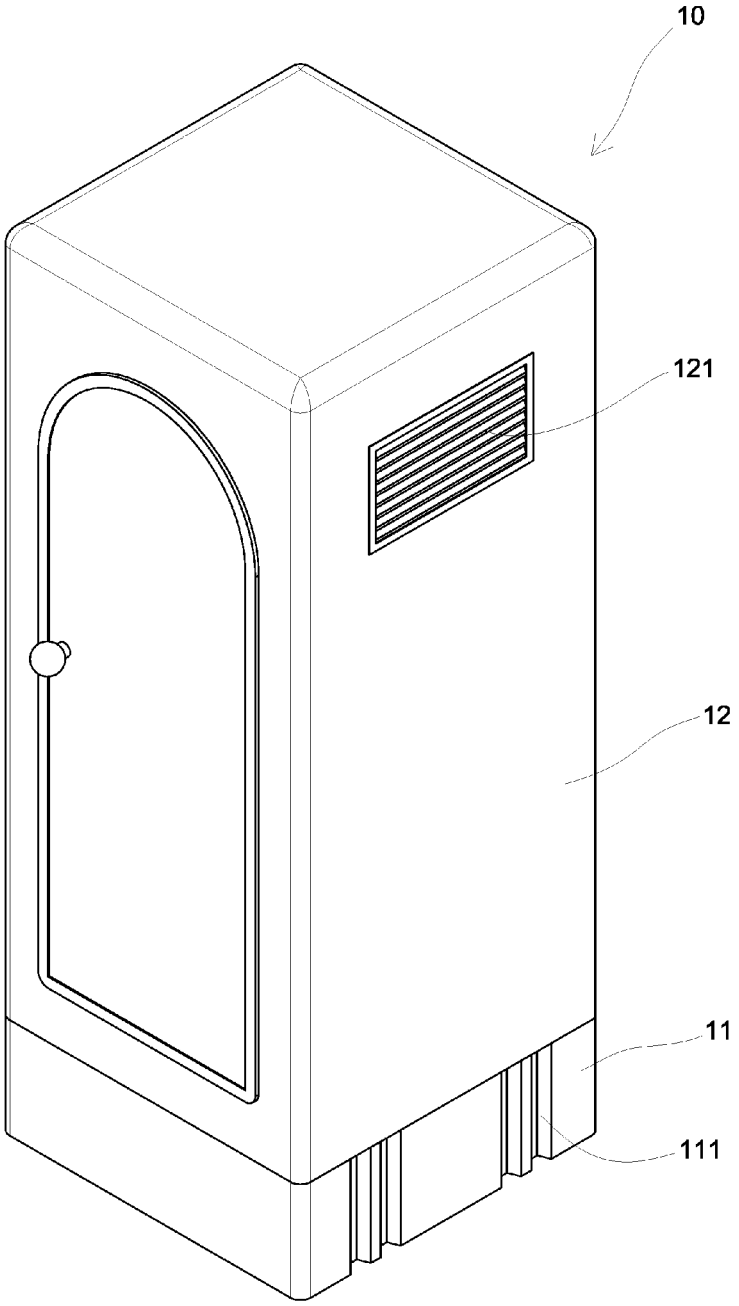
FIG.1 PRIOR ART
FIG. 1 is a pictorial view showing a conventional mobile toilet.
Figure 2:
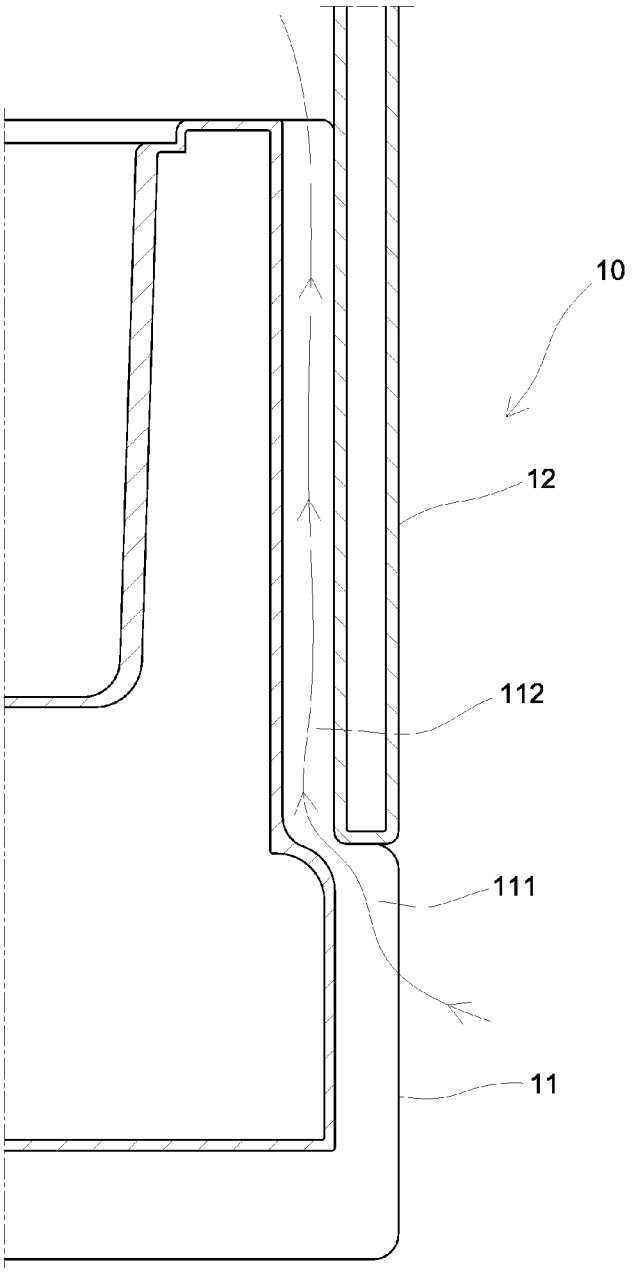
FIG.2 PRIOR ART
FIG. 2 is a schematically partial cross-sectional view showing the conventional mobile toilet.
Figure 3:
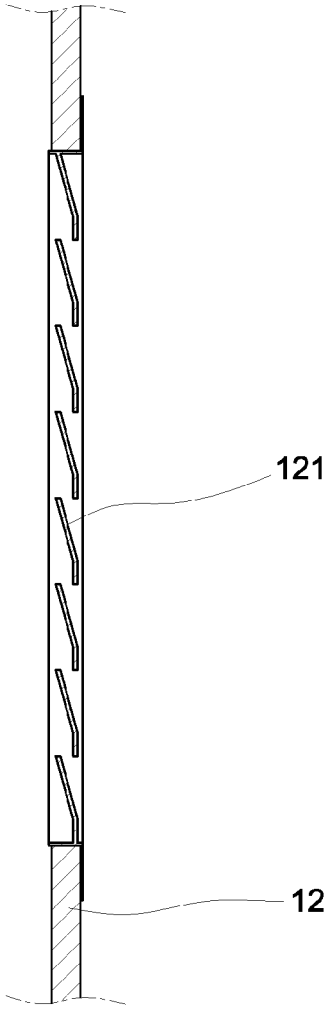
FIG.3 PRIOR ART
FIG. 3 is a schematically cross-sectional view showing a grid plate of the conventional mobile toilet.
Figure 4:
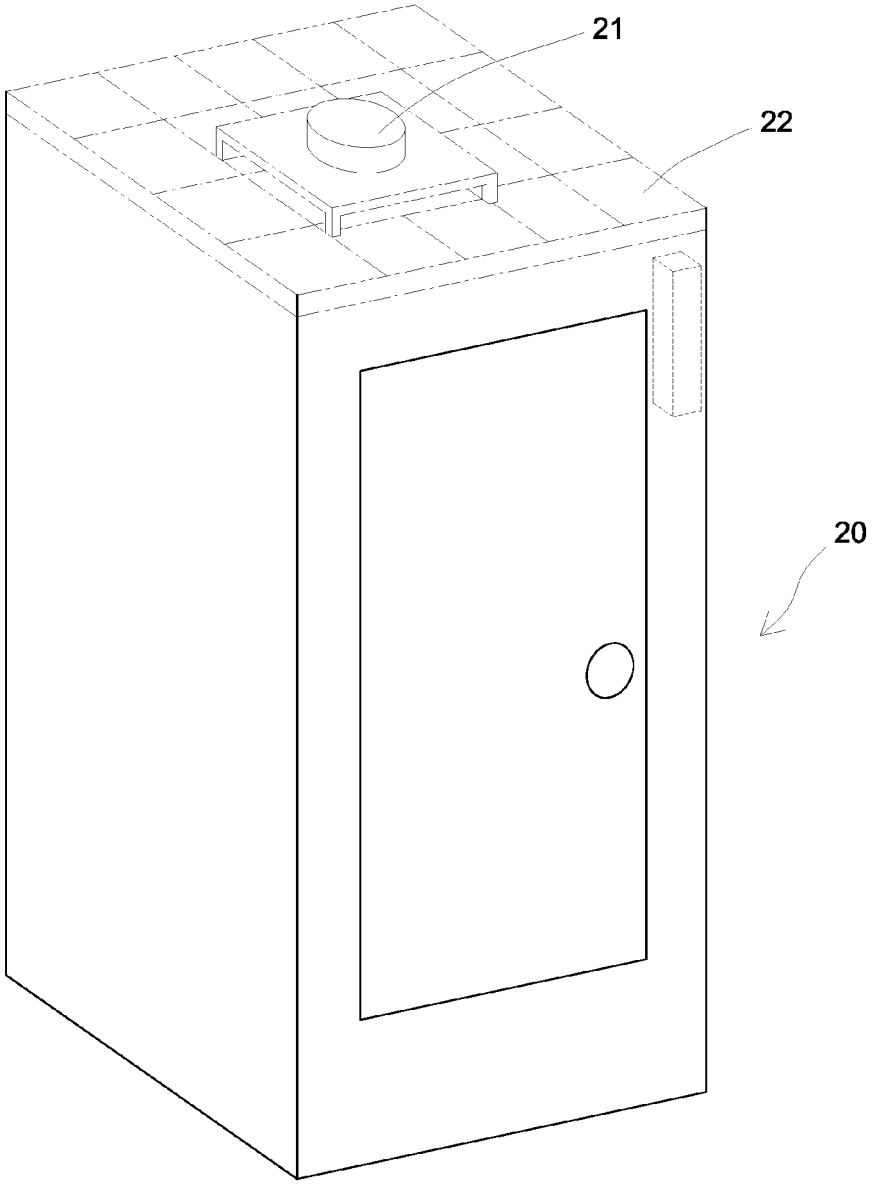
FIG.4 PRIOR ART
FIG. 4 is a pictorial view showing another conventional mobile toilet.
Figure 5:
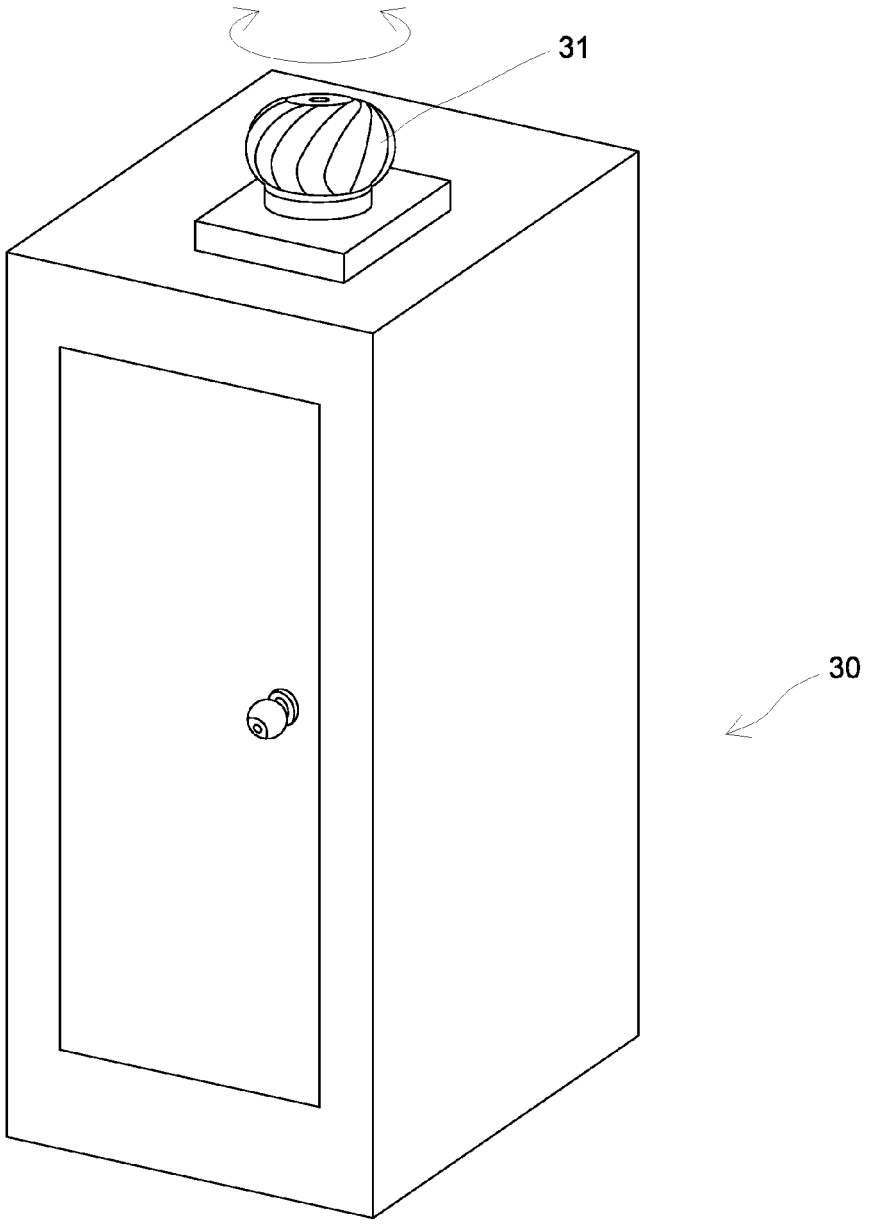
FIG.5 PRIOR ART
FIG. 5 is a pictorial view showing still another conventional mobile toilet.
Figure 6:
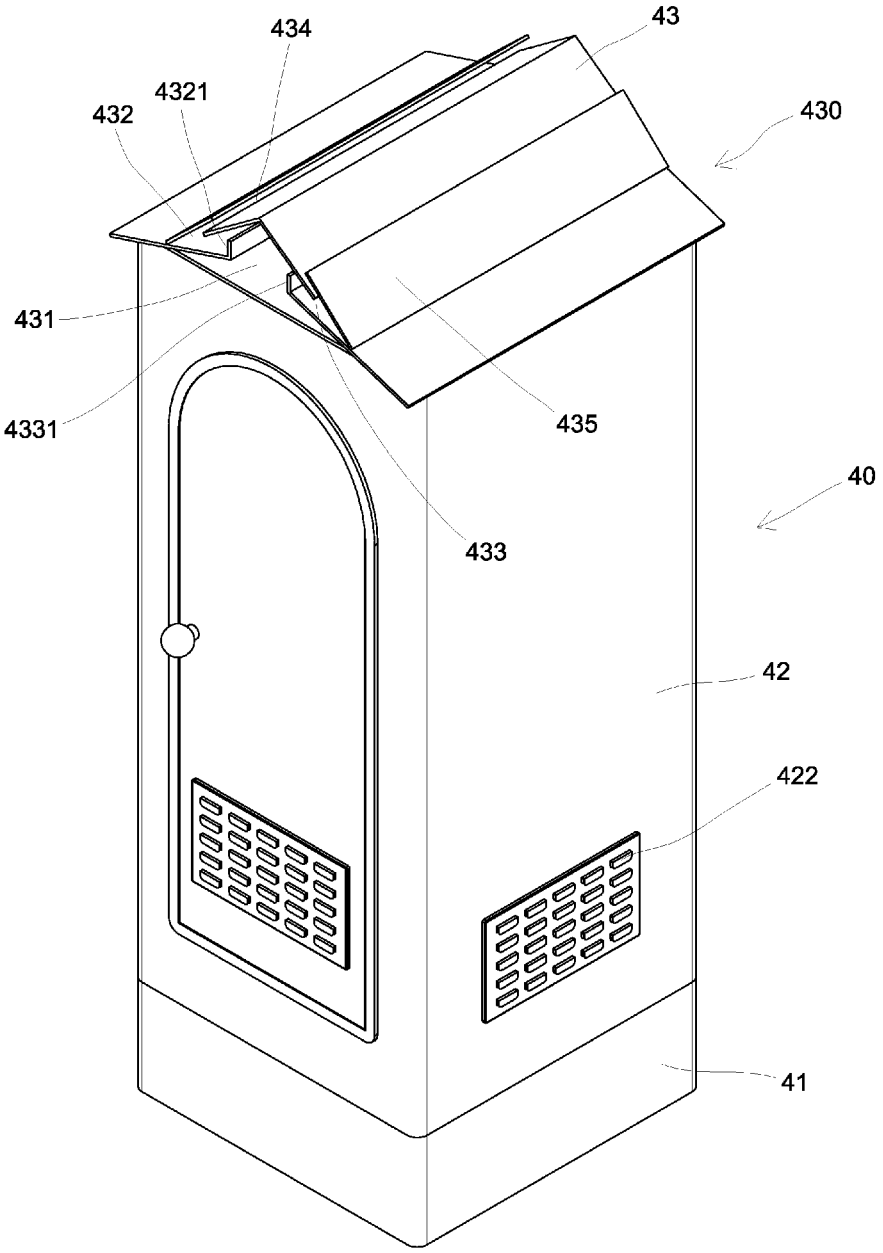
FIG. 6 shows a roof's cross-section and an overall pictorial assembled view according to a first embodiment of the invention.
Figure 7:
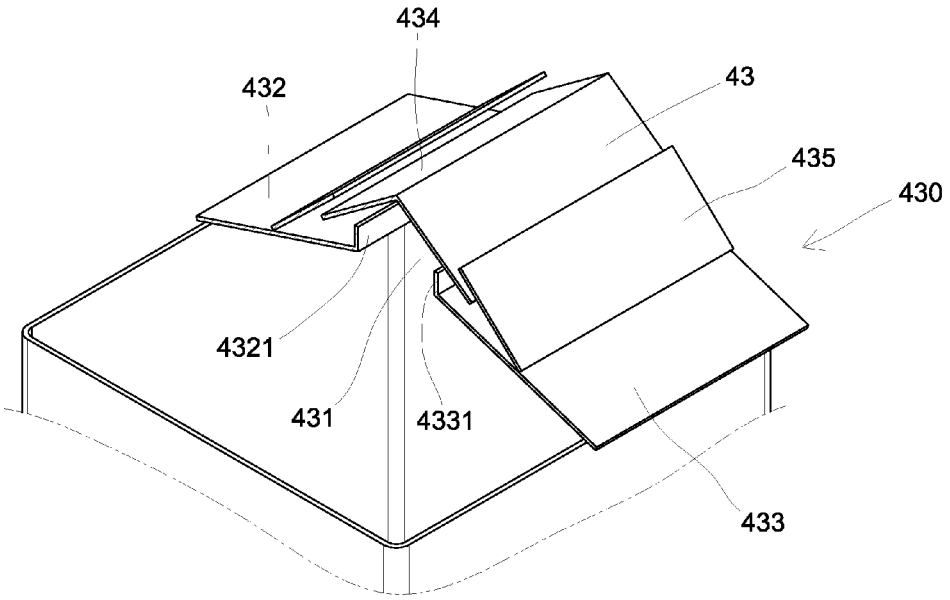
FIG. 7 is a pictorial view showing the roof being cut according to the first embodiment of the invention.
Figure 8:
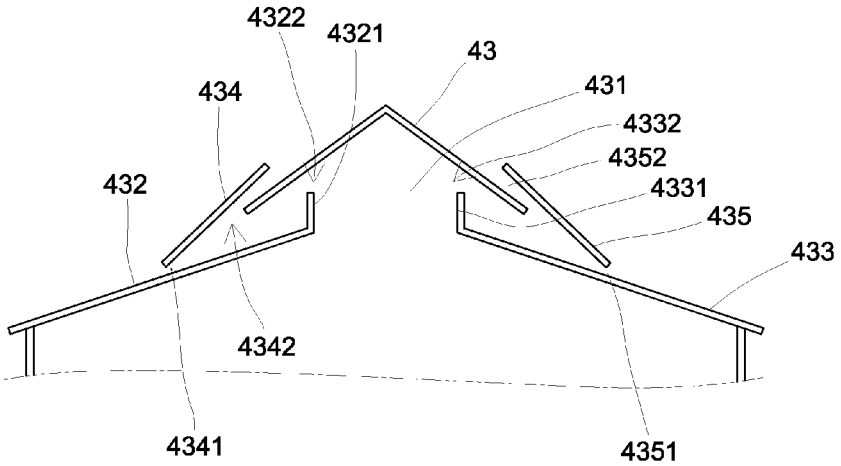
FIG. 8 is a schematic plane view showing the roof according to the first embodiment of the invention.
Figure 9:
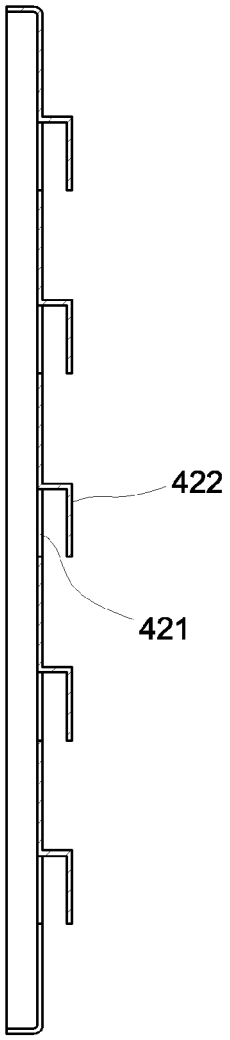
FIG. 9 is a schematically cross-sectional view showing a grid plate according to the first embodiment of the invention.

Referring to FIGS. 6 to 9, a mobile toilet 40 with a ventilation and heat-dissipating device according to a first embodiment of the invention comprises a base 41 and a main body 42. The base 41 is connected to a bottom of the main body 42. Apparatuses, such as a toilet bowl and the like, are disposed on the base 41. Since the structures of the apparatuses are not the key feature of the invention, detailed descriptions thereof will be omitted. The main body 42 is a rectangular box, in which a hose and water-collecting, flushing and hand-washing apparatuses (detailed structures thereof will be omitted because they are not the key features of the invention) may be mounted. Several ventilation openings 421 are disposed at positions in the lower half portion of the total height of the base 41 and the main body 42. An exhaust port 431 and a canopy device 430 are disposed on a top of the main body 42. The top of the main body 42 is a roof 43, wherein the exhaust port 431 and the canopy device 430 are disposed on the roof 43. The exhaust port 431 is disposed on an inner side of the roof 43, so that the hot air and odors are exhausted from the exhaust port 431. The roof 43 comprises a left sluicing top 432 and a right sluicing top 433. The left sluicing top 432 has a left inner barrier 4321 disposed on the left side of the roof 43. The left inner barrier 4321 is formed by extending a top end of the left sluicing top 432 upwards. A secondary exhaust port 4322 is disposed between the left inner barrier 4321 and the roof 43. The right sluicing top 433 has a right inner barrier 4331 disposed on a right side of the roof 43. The right inner barrier 4331 is formed by extending a top end of the right sluicing top 433 upwards. A secondary exhaust port 4332 is disposed between the right inner barrier 4331 and the roof 43. An additional left sluicing top 434 is disposed above the left sluicing top 432, and a scupper 4341 is disposed below the additional left sluicing top 434. A vent 4342 is disposed between the additional left sluicing top 434 and the roof 43. An additional right sluicing top 435 is disposed above the right sluicing top 433, and a scupper 4351 is disposed below the additional right sluicing top 435. A vent 4352 is disposed between the additional right sluicing top 435 and the roof 43.

The ventilation openings 421 of the main body 42 is constituted by a grid plate 422, which is formed by arranging several oblique plates in parallel with gaps disposed therebetween. The ventilation opening 421 is formed between the oblique plates so that the user in the toilet can be shielded, and the external air can enter the toilet.

With the above-mentioned structure device of the first embodiment, the chimney effect and the thermal convection principle are utilized so that the hot flow is formed in the main body 42, and the hot flow moves upwards so that the lower ventilation openings 421 guide the air into the mobile toilet 40, and the hot air and stinks in the mobile toilet 40 flow upwardly to the exhaust port 431. Then, the hot air and stinks are heavily exhausted from the secondary exhaust ports 4322, 4332 and vents 4342, 4352 in the S-shaped path to provide the cooling and a lot of natural convection in the mobile toilet 40. Also, the roof 43 of the canopy device 430, the additional left sluicing top 434 and the additional right sluicing top 435 block the external rainwater, and the rainwater flows out of the scuppers 4341, 4351. In addition, the right sluicing top 435 and the left sluicing top 434 are disposed slantingly, and the rainwater cannot easily flow oppositely. The left inner barrier 4321 and the right inner barrier 4331 block the rainwater from entering the toilet.

Figure 10:
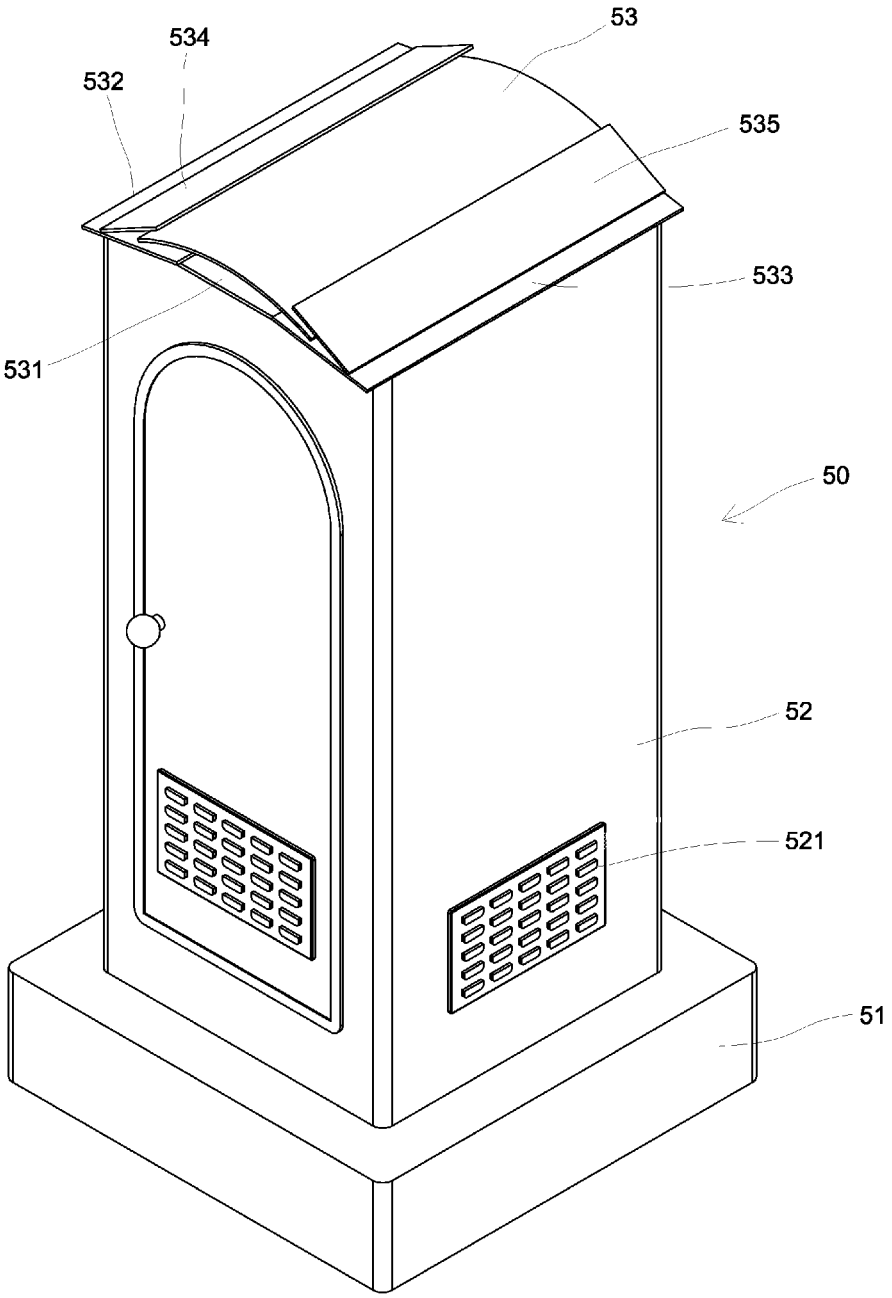
FIG. 10 shows a roofs cross-section and an overall pictorial assembled view according to a second embodiment of the invention.
Figure 11:
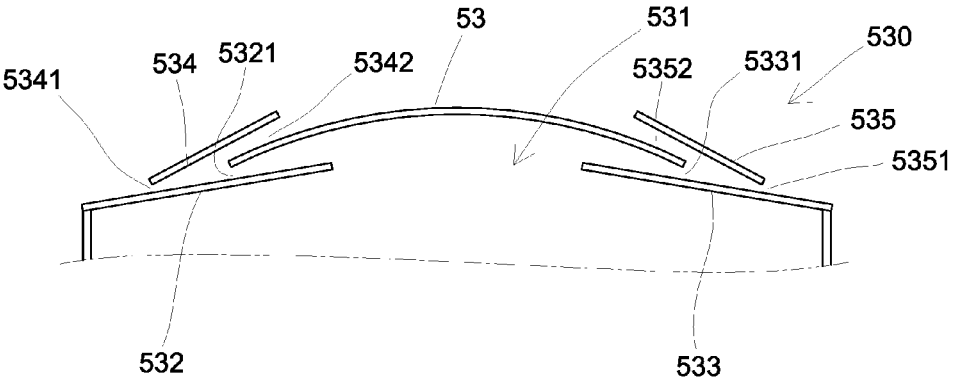
FIG. 11 is a schematic plane view showing the roof according to the second embodiment of the invention.

Referring to FIGS. 10 and 11, a mobile toilet 50 of the second embodiment comprises a base 51 and a main body 52. The base 51 is connected to a bottom of the main body 52. Several ventilation openings 521 are disposed at positions in the lower half portion of the total height of the base 51 and the main body 52. An exhaust port 531 and a canopy device 530 are disposed on a top of the main body 52. The top of the main body 52, on which the exhaust port 531 and the canopy device 530 are disposed, is an arced roof 53. The exhaust port 531 is disposed on an inner side of the roof 53. The roof 53 comprises a left sluicing top 532 and a right sluicing top 533. The left sluicing top 532 is disposed on a left side of a top of the roof 53. A secondary exhaust port 5321 is disposed between the left sluicing top 532 and the roof 53. The right sluicing top 533 is disposed on a right side of the top of the roof 53. A secondary exhaust port 5331 is disposed between the right sluicing top 533 and the roof 53. An additional left sluicing top 534 is disposed above the left sluicing top 532, and a scupper 5341 is disposed below the additional left sluicing top 534. A vent 5342 is disposed between the additional left sluicing top 534 and the roof 53. An additional right sluicing top 535 is disposed above the right sluicing top 533, and a scupper 5351 is disposed below the additional right sluicing top 535. A vent 5352 is disposed between the additional right sluicing top 535 and the roof 53.

In the second embodiment, the chimney effect and the thermal convection principle are utilized so that the hot flow is formed in the main body 52, and the hot flow moves upwards so that the lower ventilation openings 521 guide the air into the mobile toilet 50, and the hot air and stinks in the mobile toilet 50 flow upwardly to the exhaust port 531. Then, the hot air and stinks are heavily exhausted from the secondary exhaust ports 5321, 5331 and vents 5342, 5352 in the S-shaped path to provide the cooling and a lot of natural convection in the mobile toilet 50. Also, the roof 53 of the canopy device 530, the additional left sluicing top 534 and the additional right sluicing top 535 block the external rainwater, and the rainwater flows out of the scuppers. In addition, the right sluicing top 533 and the left sluicing top 532 are disposed slantingly, and the rainwater cannot easily flow oppositely, thereby preventing the rainwater from entering the toilet.

Figure 12:
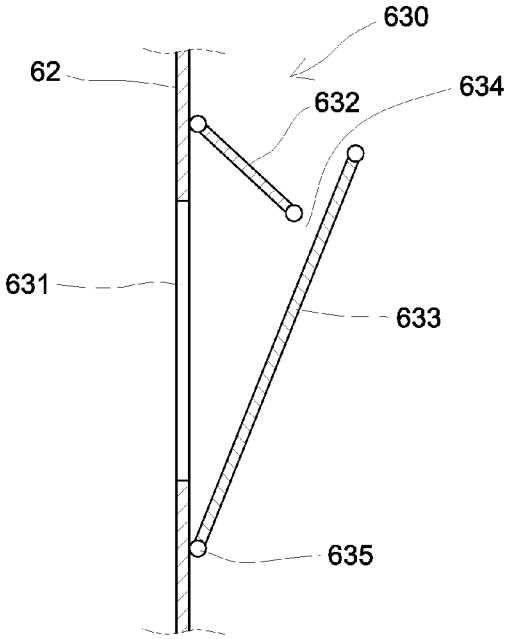
FIG. 12 is a schematically cross-sectional view showing an exhaust port and a canopy device according to the third embodiment of the invention.

Referring to FIG. 12 of the third embodiment, an exhaust port 631 and a canopy device 630 are disposed on a window of a side surface of the main body 62, and the window serves as the exhaust port 631. A top shutter 632 and an oblique plate 633 are disposed outside the exhaust port 631. The top shutter 632 is disposed on a top edge of the window and inclined by an angle. The oblique plate 633 is disposed on a bottom edge of the window and inclined by an angle. A secondary exhaust port 634 is disposed between the oblique plate 633 and the top shutter 632. A scupper 635 is disposed between the oblique plate 633 and a wall of the main body 62. The chimney effect and the thermal convection principle are utilized so that the hot flow is formed in the main body 62, and the hot flow moves upwards so that the lower ventilation openings guide the air into the mobile toilet, and the hot air and stinks in the mobile toilet flow upwardly to the exhaust port 631 (window). Then, the hot air and stinks are heavily exhausted from the secondary exhaust port 634 to provide the cooling and a lot of natural convection in the mobile toilet. The top shutter 632 of the canopy device 630 blocks the external rainwater, so that the rainwater flows out of the scupper to prevent the rainwater from entering the toilet.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A mobile toilet with a ventilation and heat-dissipating device, the mobile toilet comprising: a base and a main body, the base is connected to a bottom of the main body, ventilation openings disposed at positions of a lower half portion of a total height of the base and the main body, an exhaust port and a canopy device disposed at a top of the main body, a roof disposed to the exhaust port and the canopy device, the exhaust port disposed on an inner side of the roof, the roof having a left sluicing top and a right sluicing top, the left sluicing top having a left inner barrier on a left side of the roof, the left inner barrier extending from a top end of the left sluicing top, a secondary exhaust port disposed between the left inner barrier and the roof, the right sluicing top having a right inner barrier disposed on a right side of the roof, the right inner barrier extending from a top end of the right sluicing top, a secondary exhaust port disposed between the right inner barrier and the roof, an additional left sluicing top disposed above the left sluicing top, a scupper disposed below the additional left sluicing top, a vent disposed between the additional left sluicing top and the roof, an additional right sluicing top disposed above the right sluicing top, another scupper disposed below the additional right sluicing top, and a vent disposed between the additional right sluicing top and the roof; wherein the ventilation openings guide air into the mobile toilet, so that hot air and odors in the mobile toilet flow upwardly to the exhaust port, thereby exhausting the hot air and the odors, and cooling the mobile toilet, wherein the canopy device blocks external rainwater.

2. The mobile toilet according to claim 1, wherein the ventilation openings of the main body are constituted by a grid plate, and the grid plate is formed by oblique plates arranged in parallel with gaps disposed between the oblique plates.

3. A mobile toilet with a ventilation and heat-dissipating device, the mobile toilet comprising: a base and a main body, the base connected to a bottom of the main body, ventilation openings disposed at positions of a lower half portion of a total height of the base and the main body, an exhaust port and a canopy device disposed at a top of the main body, an arced roof disposed to the exhaust port and the canopy device, the exhaust port disposed on an inner side of the roof, the roof having a left sluicing top and a right sluicing top, the left sluicing top disposed on a left side of the roof, a secondary exhaust port disposed between the left sluicing top and the roof, the right sluicing top disposed on a right side of the roof, a secondary exhaust port disposed between the right sluicing top and the roof, an additional left sluicing top disposed above the left sluicing top, a scupper disposed below the additional left sluicing top, a vent disposed between the additional left sluicing top and the roof, an additional right sluicing top disposed above the right sluicing top, another scupper disposed below the additional right sluicing top, and a vent disposed between the additional right sluicing top and the roof; wherein the ventilation openings guide air into the mobile toilet, so that hot air and odors in the mobile toilet flow upwardly to the exhaust port, thereby exhausting the hot air and the odors, and cooling the mobile toilet, wherein the canopy device blocks external rainwater.

4. The mobile toilet according to claim 3, wherein the ventilation openings of the main body are constituted by a grid plate, and the grid plate is formed by oblique plates arranged in parallel with gaps disposed between the oblique plates.

5. A mobile toilet with a ventilation and heat-dissipating device, the mobile toilet comprising: a base and a main body, the base connected to a bottom of the main body, ventilation openings disposed at positions of a lower half portion of a total height of the base and the main body, an exhaust port and a canopy device disposed at a top of the main body, a window disposed to a side surface of the main body, the window serving as the exhaust port, a top shutter and an oblique plate disposed outside the exhaust port, the top shutter disposed on a top edge of the window and inclined by an angle, the oblique plate disposed on a bottom edge of the window and inclined by an angle, a secondary exhaust port disposed between the oblique plate and the top shutter, and a scupper disposed between the oblique plate and a wall of the main body; wherein the ventilation openings guide air into the mobile toilet, so that hot air and odors in the mobile toilet flow upwardly to the exhaust port, thereby exhausting the hot air and the odors, and cooling the mobile toilet, wherein the canopy device blocks external rainwater.

6. The mobile toilet according to claim 5, wherein the ventilation openings of the main body are constituted by a grid plate, and the grid plate is formed by oblique plates arranged in parallel with gaps disposed between the oblique plates.

* * * * *